US006101633A

United States Patent [19]

Thompson

[11] Patent Number: 6,101,633

[45] Date of Patent: Aug. 15, 2000

[54] ALUMINUM CAN HAT

[76] Inventor: Norval Thompson, 9016 Rosemary Ave., St. Louis, Mo. 63124

[21] Appl. No.: 09/326,784

[22] Filed: Jun. 4, 1999

[51] Int. Cl.[7] ..... A42B 1/00

[52] U.S. Cl. ..... 2/200.1; 2/175.1; 2/195.1

[58] Field of Search ..... 2/200.1, 175.1, 2/175.2, 175.5, 195.1

[56] References Cited

U.S. PATENT DOCUMENTS

| | | | |
|---|---|---|---|
| D. 214,015 | 5/1969 | Hicks . | |
| 3,766,565 | 10/1973 | Cozzens | 2/200.1 |
| 5,023,117 | 6/1991 | Stephens | 2/200.1 |
| 5,428,842 | 7/1995 | Wise | 2/195.1 |
| 5,553,327 | 9/1996 | Koecher et al. . | |

*Primary Examiner*—Bibhu Mohanty
*Attorney, Agent, or Firm*—Polster, Lieder, Woodruff & Lucchesi

[57] ABSTRACT

The present invention provides a hat made from aluminum cans and the method for making the hat. The tops and bottoms of aluminum beverage cans are removed leaving aluminum can pieces which are formed into a hat. The ends of several can pieces are linked together to form a hat band. The sides of three aluminum can pieces are linked and a circular hat crown is cut and affixed to the hat band. A bill is cut from one aluminum can piece and affixed to the hat band by use of lacing through punched holes.

11 Claims, 5 Drawing Sheets

ALUMINUM CAN HAT

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a hat made from aluminum cans and the method of preparation thereof.

Many beverages are packaged in 12 ounce cans of aluminum. Graphics of all kinds are printed on the cans and are frequently of bright colors and interesting designs. Although used beverage cans are recycled in order to reuse the aluminum, many people enjoy displaying a favorite brand as a collector's item or a novelty item.

Wearing apparel, particularly hats, is used to exhibit brand loyalty and flashy designs. Hats have been long standing objects of means for displaying individuality and style. Thus it is desirable to create a new use for these decorated aluminum cans by manufacturing stylish hats displaying the colorful graphics.

SUMMARY OF THE INVENTION

The present invention relates to a hat made from aluminum cans and a method for making the hats. The top and bottom of the aluminum can are removed leaving a rectangular aluminum piece which is easily cut and/or assembled with other aluminum pieces to form a hat. The hat comprises a pillbox configuration wherein the sides of the hat, i.e., a hat band, comprise a circle and the top is a flat crown. A bill is cut from one or two layers of aluminum can pieces, and is fastened to the front portion of the sides of the pillbox. A preferred embodiment resembles a Civil War style hat. The graphics of the cans are displayed on both the exterior and interior of the hat.

The method of making the hat comprises placing the aluminum can pieces inside to inside so a single aluminum can piece displays the graphics on both sides. The aluminum can pieces are assembled by folding an edge of the aluminum can piece back on itself to provide a fold having a narrow "V". Another aluminum can piece with a like fold is interlocked with the first aluminum can piece and the interlocked folds are crimped thereby connecting one aluminum can piece with another. The rectangular pieces can be connected end to end or side to side. The connecting technique is used whether the aluminum can piece is of single or double thickness.

When assembling a typical hat, about 4 double aluminum can pieces are connected end to end and formed into a circle to provide the vertical round sides of the pillbox. A circular crown having substantially the same diameter as the circle formed by the round vertical sides, is cut from about three double aluminum can pieces connected side to side and fastened to the vertical round sides by use of adhesives, silicon caulk or other suitable means of fastening. This completes the pillbox portion of the hat.

Optionally a bill for the hat is cut from a single aluminum can piece of double thickness. The bill is attached to the pillbox preferably by punching holes in the bill and in the pillbox and using a strong lacing to affix the bill to the pillbox thus finishing the hat.

It is also desirable to place a lining in the hat around the lower portion of the pillbox on the inside to provide a more comfortable fit. The lining comprises a thin foam strip, cork, felt or other suitable material.

Ordinarily a connecting fold is about ¼ inch in width, but if desired, a fold can be about one inch in width and is only gently crimped so as to allow the one inch fold to diminish in size to about ¼ inch so as to provide adjustment for different hat sizes. Two of the larger folds provide adjustment to a large number of hat sizes.

DETAILED DESCRIPTION OF THE INVENTION

Figure 1:
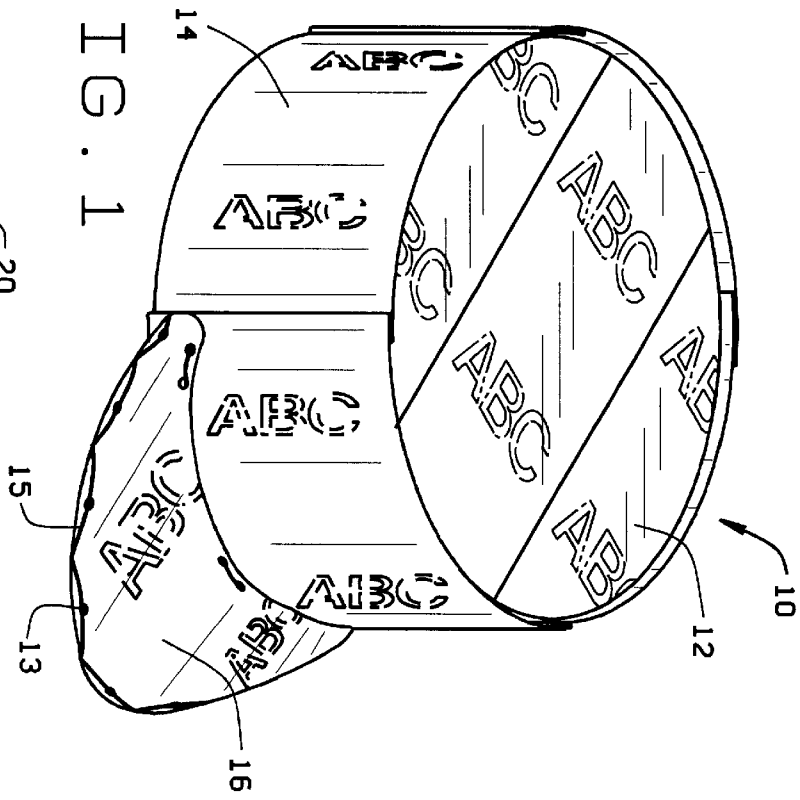
FIG. 1 is a perspective view of one embodiment of the present invention.

FIG. 1 is a perspective view of one embodiment of the invention depicting a hat 10 made from aluminum can pieces 18 which hat has a crown 12, vertical sides 14 and a bill 16. The crown 12 is affixed to the vertical sides 14 by means of adhesive, silicon caulk or the like. The bill 16 is affixed to the vertical sides 14 at the front of the hat 10 by means of holes 13 punched in the bill 16 and sides 14 and the application of lacing 15. The combination of the crown 12 and the vertical sides 14 give the appearance of a pillbox configuration.

Figure 2:
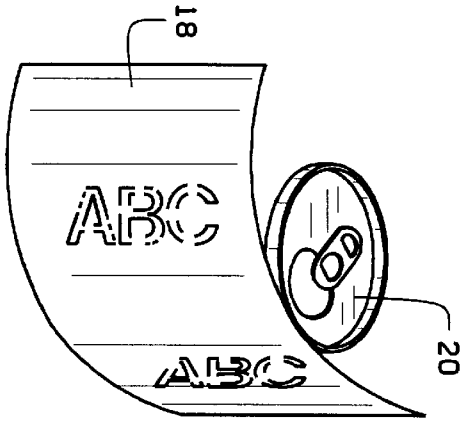
FIG. 2 is a perspective view of formation of one aluminum can piece.
Figure 3:
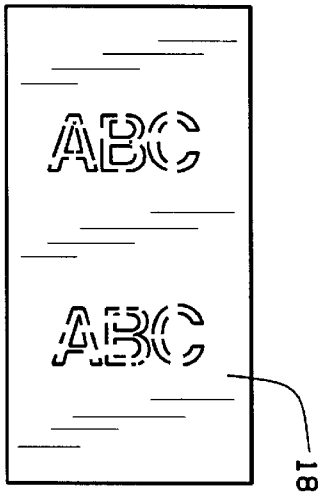
FIG. 3 is a top plan view of the aluminum can piece of FIG. 2.

FIGS. 2 and 3 describe obtaining a typical aluminum can piece from which all parts of the novel hat are prepared. The can lid 20 and bottom (not shown) are removed to provide a rectangular aluminum can piece 18.

Figure 4:
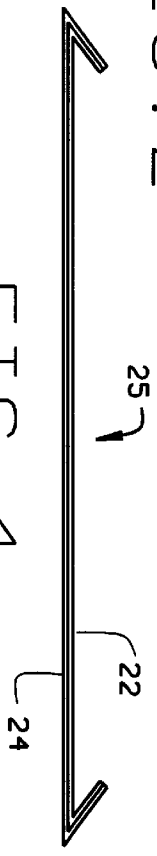
FIG. 4 is a side elevational view of two aluminum can pieces juxtaposed one upon the other with folds.

FIG. 4 is a side elevational view of two can pieces 22 and 24 juxtaposed one upon the other with the ends folded back to form an aluminum can element 25 which displays graphics on both sides.

Figure 5:
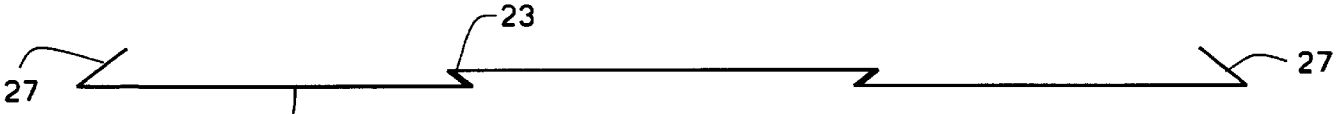
FIG. 5 is a side elevational view of aluminum can pieces end to end.

FIG. 5 is a side elevational view of three aluminum can elements 26 interlocked with small folds 23 and larger folds 27 to form the basis for the vertical sides of the hat 10. The small folds 23 are crimped to securely fasten the can elements 26. The larger folds 27 are interlocked in such a manner as to allow the vertical side piece 14 of the hat to expand and contract for adjustment to different hat sizes.

Figure 6:
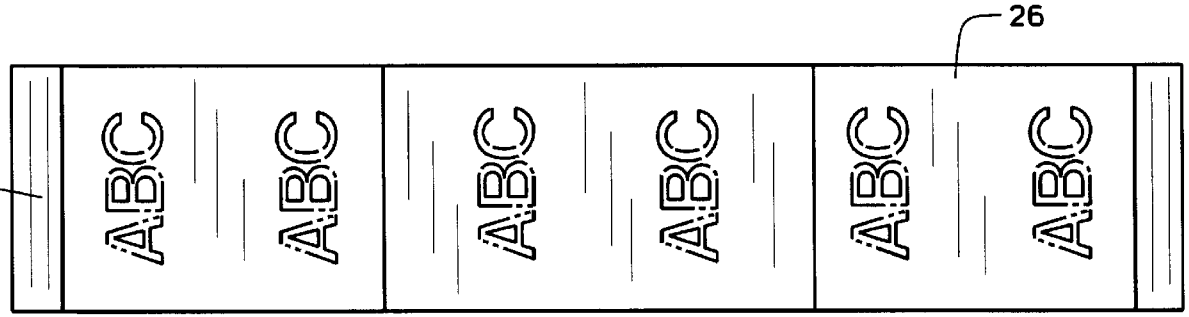
FIG. 6 is a top plan view of the can pieces of FIG. 5.

FIG. 6 is a top view of the connected three aluminum can pieces 26 which provide the vertical sides for the hat 10. Graphics of the nature seen on the surface also appear on the underside because the aluminum can pieces are a double layer.

Figure 7:
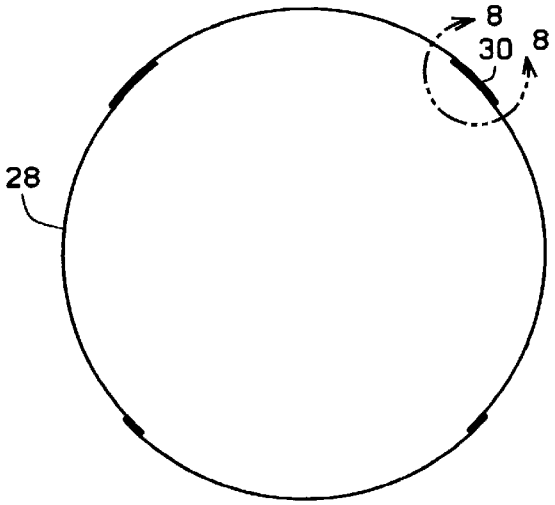
FIG. 7 is a top plan view of the can pieces of FIGS. 5 and 6 after joining to form a circle.

FIG. 7 is a top view of the circular vertical sides 28 of the hat wherein the folds 27 have been interlocked to form a cylinder 28. The cylinder 28 contains two expandable joints 30 depicted in enlarged form in FIG. 8. The expandable joint 30 is approximately one inch in width so that the hat can be adjusted to fit the size of the head of the wearer. With two expandable joints 30, adjustment can be extended almost two inches. This adequately covers the size range for most heads.

Figure 9:
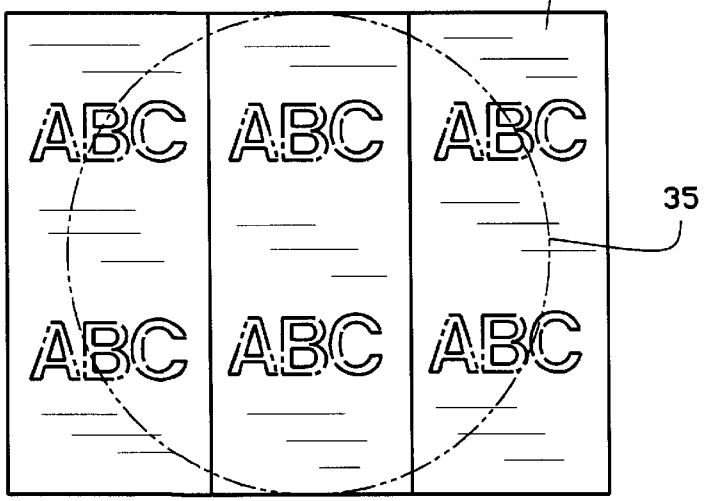
FIG. 9 is a top plan view of three aluminum can pieces joined side to side.

FIG. 9 is a top plan view of three aluminum can pieces 18 joined by foldover seams to provide a double layer square 34 from which a circle 35 is cut to form the crown 12 of the hat 10.

Figure 10:
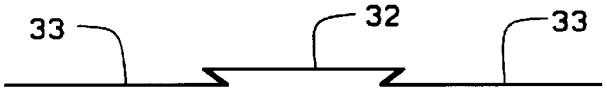
FIG. 10 is a side elevational view of FIG. 9.

FIG. 10 is a side elevational view of the square 34 depicting the center aluminum can piece 32 and the two outside pieces 33 joined by the same interlocking folds 23 as those in FIG. 5.

Figure 11:
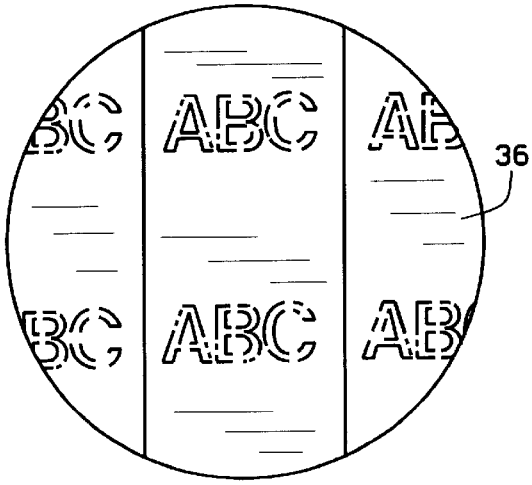
FIG. 11 is a top plan view of a crown of one embodiment of the present invention.
Figure 12:
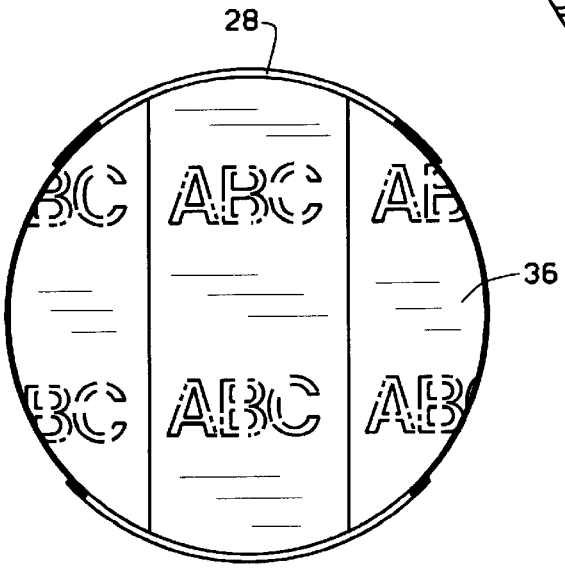
FIG. 12 is a top plan view of FIGS. 7 and 11 when combined.

FIG. 11 is a top plan view of the crown 36 for the hat 10. The crown 36 is a double layer to provide graphics on both sides. In FIG. 12, the crown 36 is joined to the cylinder 28 by use of adhesive, silicon caulk or the like to form the pill box portion of the hat 10.

Figure 8:
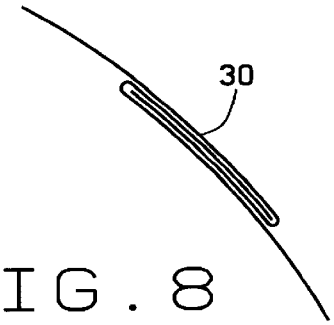
FIG. 8 is an enlarged plan view of the region 8—8.
Figure 13:
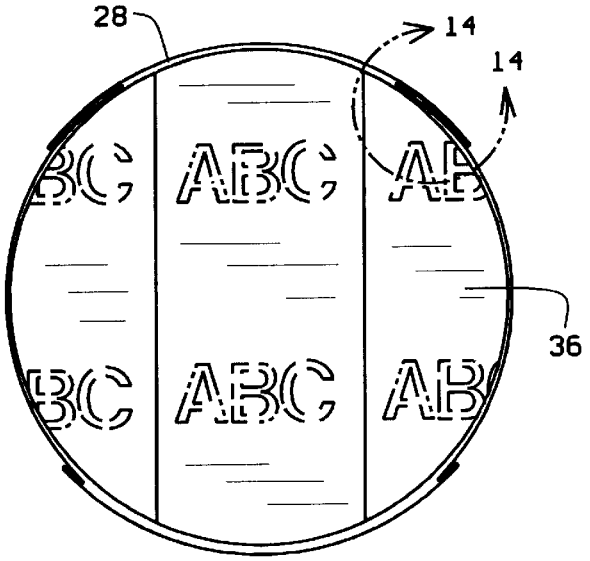
FIG. 13 is a top plan view of another embodiment of the present invention.
Figure 14:
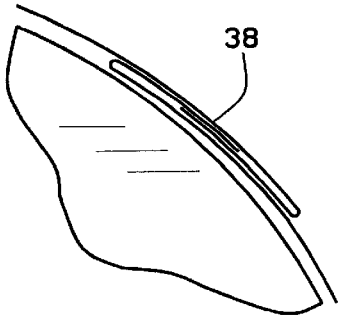
FIG. 14 is a top plan view of the section 14—14 of FIG. 13.

FIG. 13 is a top plan view of the crown 36 after placement in the circle created by the cylinder 28 wherein the joint 38, enlarged from the portion 14—14 shown in FIG. 14, has been extended from that shown in FIG. 8 as the joint 30. Thus the drawing in FIG. 13 provides a hat of larger size than that shown in FIG. 7.

Figure 15:
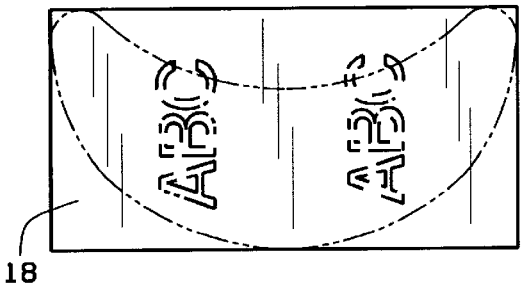
FIG. 15 is a top plan view of one aluminum can piece.

FIG. 15 depicts an aluminum can piece 18 upon which is marked the outline of a bill for a hat. The bill 40 is cut from the aluminum can piece, either in single or double layer form, using a satisfactory cutting device.

Figure 16:
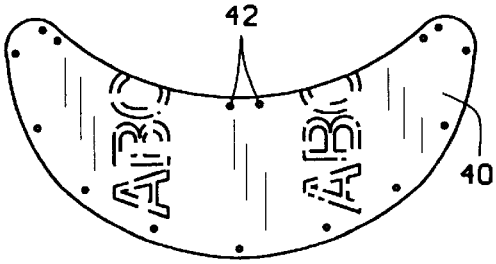
FIG. 16 is a top plan view of the cut out portion designated in FIG. 15.
Figure 17:
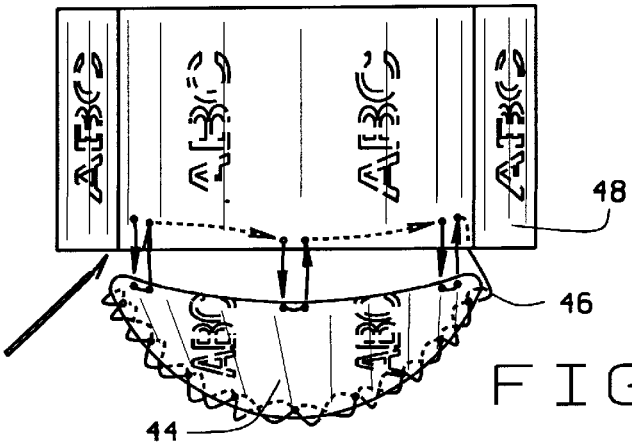
FIG. 17 is a side elevational view of means of attachment for the piece from FIG. 16 to the already formed pill box.

FIG. 16 exemplifies a typical bill 40 with holes 42 punched in the bill to allow the use of lacing 46 to attach the bill as shown in FIG. 17. Holes are also punched in the circular vertical sides 48 so as to pass the lacing through to affix the bill 44 to the hat. The lacing 46 is overlaid to provide a decorative effect on the edge of the bill 44.

Figure 18:
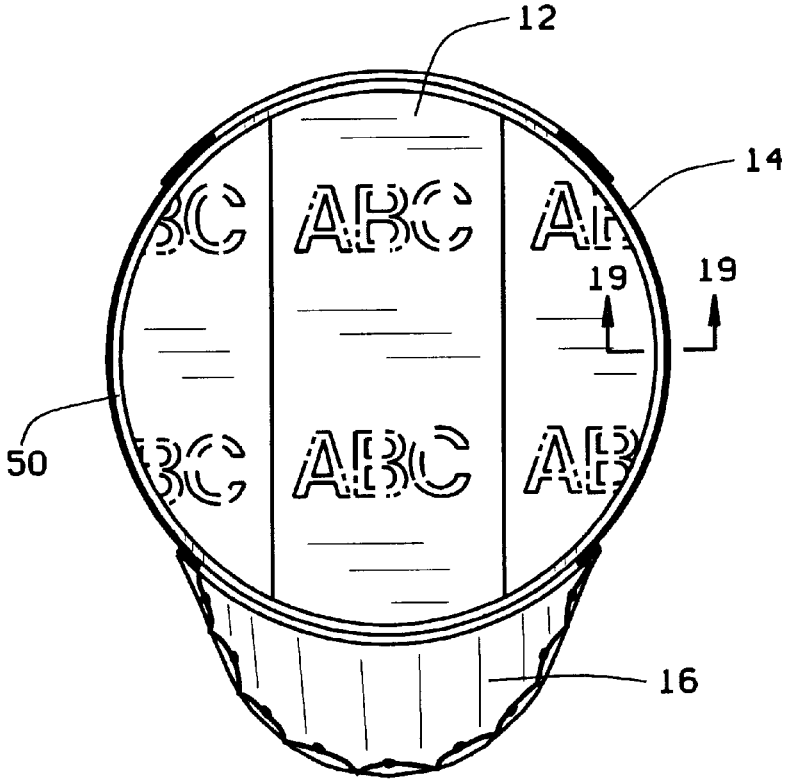
FIG. 18 is a bottom plan view of one embodiment of the present invention.

FIG. 18 is a bottom plan view of a hat with a crown 12, vertical sides 14 and a bill 16. In order to provide greater comfort, the hat also had a lining 50 about the lower part of the interior. The lining 50 can be foam, felt, leather or other soft substance to make the hat more comfortable. The bill 16, in this embodiment, is a single layer of an aluminum can piece but the crown 12 is a double layer thus showing the desired graphics on the under side of the crown 12.

Figure 19:
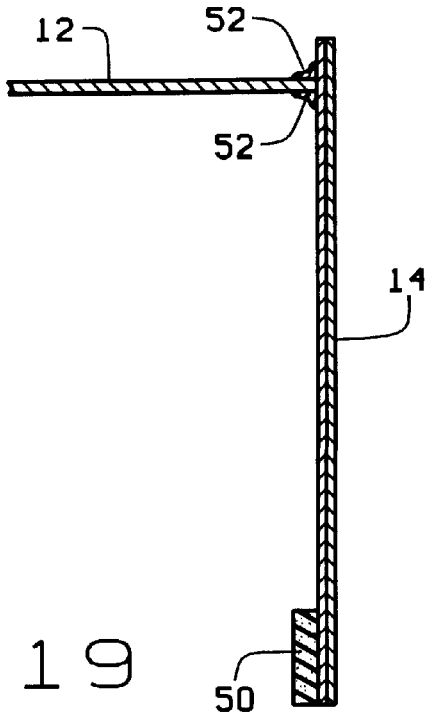
FIG. 19 is a side elevational view of the portion designated 19—19 of FIG. 18.

FIG. 19 is an exploded side elevational view of a section 19—19 exemplifying the liner 50 and the adhesive 52 which may be silicon caulk found to work particularly well, glue or other suitable substance. The adhesive 52 joins the crown 12 to the vertical sides 14 to unify the hat.

The method for preparation of a hat from aluminum can pieces is quite simple. The tops and bottoms from 16 aluminum cans are removed and the sides are trimmed to result in 16 aluminum can pieces approximately 3.5×8.25 inches. A hat adjusting to sizes 6½ to 7½ is made from 16 cans. If it is necessary to make the hat larger, then 18 cans are used. Conventionally the cans are 12 ounce cans.

Three or about 3.5 can pieces are laid end to end. The ends are folded over either about ¼ inch or about an inch. (See FIG. 5) The one inch folds are where the circumference is adjustable so as to make the hat fit comfortably. The folded over ends are linked together and crimped. The crimping is effected by use of pliers or a nail punch so that the links remain stable to provide a band of linked aluminum can pieces. The ends of the band are linked to form a hat band. If desired, the long sides of the rectangular aluminum can pieces are folded over to make a smooth non-cutting edge.

A hat crown is formed by joining the sides of three aluminum can pieces utilizing the same foldover seams. A circular template of a size substantially equal to the interior of the circular hat band is used to provide a pattern to cut out the circular crown. The crown is fastened to the hat band by use of silicon latex caulk, glue, adhesive or the like. Alternatively, the hat band and crown can be affixed to each other by punching holes in the parts and lacing them together.

Next a bill is cut, using a template, from a single aluminum can piece of either a double or single layer, and holes are punched in the bill as shown in FIGS. 15 and 16. The bill is then laced around the edge for a decorative effect and affixed to the hat band with the lacing. The bill can be a double layer aluminum can piece or a single layer in which case the under side of the bill does not display graphics. (See FIG. 18)

The foregoing description of embodiments of this invention is not intended to be a limitation to the scope of this invention. As will be apparent to those skilled in the art, many variations and modifications can be made to the composition of this invention as described in the above embodiments without departing from the spirit and scope of this invention.

What is claimed:

1. A hat made from aluminum can pieces, comprising a bill cut from an aluminum can piece and fastened to upright sides forming a circular hat band fashioned from can pieces linked longitudinally by a fold over and crimped link, and a circular crown substantially flat fashioned from a substantially rectangular shaped piece of linked aluminum can pieces fitting within the interior of the hat band to form a hat crown.

2. The hat of claim 1 wherein the hat band is comprised of three or four aluminum can pieces.

3. The hat of claim 1 wherein the hat band is comprised of a double layer of aluminum can pieces.

4. The hat of claim 1 wherein the hat crown is comprised of pieces of three aluminum can pieces.

5. The hat of claim 1 wherein the hat is comprised of 16 or 18 aluminum can pieces.

6. A method for making a hat from aluminum cans which method comprises:

(a) removing the lid and bottom from a multiplicity of empty aluminum cans to obtain a multiplicity of similar sized rectangular aluminum can pieces;

(b) linking several aluminum can pieces end to end by folding an edge of an end over on itself on each end of each piece, interlocking the folded over ends and crimping the interlocked portions to form a band of several aluminum can pieces;

(c) linking the ends of the band to form a circular hat band;

(d) forming a hat crown by linking the sides of three aluminum can pieces by foldover and crimping and cutting out a circle substantially equal in size to the interior of the previously formed hat band;

(e) fastening the crown to the hat band by use of adhesive, silicone latex caulk, or glue or by punching holes in the hat band and the crown and fastening the parts together by use of appropriate lacing;

(f) cutting a bill for the hat from an aluminum can piece; and (g) affixing the bill to the hat band by punching holes in the bill and the band and lacing the bill to the band using appropriate lacing.

7. The method of claim 6 wherein all aluminum can pieces are double layers of aluminum can pieces.

8. The method of claim 6 wherein the hat band is comprised of four double layer aluminum can pieces having eight ends, four of which are folded over ¼ inch and four ends are folded over one inch to provide two one inch links for adjusting the size of the hat.

9. The method of claim 7 wherein the hat band is comprised of 3.5 aluminum can pieces.

10. The method of claim 6 wherein the hat band and crown are fastened together using silicone latex caulk.

11. The method of claim 6 wherein the hat band and crown are fastened together using appropriate lacing.

* * * * *